US008870606B2

(12) United States Patent
Yu et al.

(10) Patent No.: US 8,870,606 B2
(45) Date of Patent: Oct. 28, 2014

(54) ELECTRICAL CONNECTOR FOR CONNECTING TO CABLES

(75) Inventors: Wang-I Yu, Jhonghe (TW); Hung-Chi Tai, Jhonghe (TW); Yung-Chih Hung, Jhonghe (TW)

(73) Assignee: Alltop Electronics (Suzhou) Ltd., Taicang, JiangSu Province (CN)

( * ) Notice: Subject to any disclaimer, the term of this patent is extended or adjusted under 35 U.S.C. 154(b) by 162 days.

(21) Appl. No.: 13/601,296

(22) Filed: Aug. 31, 2012

(65) Prior Publication Data

US 2013/0337703 A1 Dec. 19, 2013

(30) Foreign Application Priority Data

Jun. 19, 2012 (CN) ..... 2012 1 0201824

(51) Int. Cl.
*H01R 13/502* (2006.01)
*H01R 13/506* (2006.01)
*H01R 13/514* (2006.01)

(52) U.S. Cl.
CPC ..... *H01R 13/514* (2013.01); *H01R 13/506* (2013.01)
USPC ..... 439/701

(58) Field of Classification Search
CPC .. H01R 13/506; H01R 13/514; H01R 13/518; H01R 13/516
USPC ..... 439/701, 660, 108
See application file for complete search history.

(56) References Cited

U.S. PATENT DOCUMENTS

| | | | | |
|---|---|---|---|---|
| 4,602,831 | A * | 7/1986 | Lockard | 439/108 |
| 5,934,942 | A * | 8/1999 | Patel et al. | 439/607.5 |
| 6,203,376 | B1 * | 3/2001 | Magajne et al. | 439/607.44 |
| 6,758,694 | B2 * | 7/2004 | Liu | 439/606 |
| 6,893,295 | B1 * | 5/2005 | Lloyd et al. | 439/607.05 |
| 6,974,353 | B2 * | 12/2005 | Liu et al. | 439/680 |
| 7,083,465 | B2 * | 8/2006 | Wu | 439/497 |
| 7,207,832 | B2 * | 4/2007 | Liu et al. | 439/499 |
| 7,485,013 | B2 * | 2/2009 | Kuo | 439/731 |
| 7,607,947 | B1 * | 10/2009 | Ho | 439/607.36 |
| 7,651,379 | B1 * | 1/2010 | Wu | 439/660 |
| 7,815,471 | B2 * | 10/2010 | Wu | 439/640 |
| 7,976,350 | B2 * | 7/2011 | Ho | 439/731 |
| 8,011,977 | B2 * | 9/2011 | Tsuruta et al. | 439/752 |
| 8,430,693 | B2 * | 4/2013 | Wu | 439/607.5 |
| 8,579,519 | B2 * | 11/2013 | Wu | 385/75 |
| 2004/0067680 | A1 * | 4/2004 | Wu | 439/497 |
| 2013/0337692 | A1 * | 12/2013 | Yu et al. | 439/626 |

* cited by examiner

*Primary Examiner* — Amy Cohen Johnson
*Assistant Examiner* — Vladimir Imas
(74) *Attorney, Agent, or Firm* — Sughrue Mion, PLLC

(57) ABSTRACT

An electrical connector includes an insulative housing, a contact module inserted into the insulative housing and a number of cables connected to the contact module. The contact module includes an insulative block and a number of contacts fixed in the insulative block through insert molding. The contacts includes a number of cantilevered contacting portions extending beyond the insulative block and a number of soldering pads. The cantilevered contacting portions of adjacent contacts overlap each other from a side view, while the soldering pads of the adjacent contacts are offset from each other and exposed on upper and lower surfaces of the insulative block, respectively, from the side view. As a result, the contact module can be easily assembled to the insulative housing.

18 Claims, 11 Drawing Sheets

ELECTRICAL CONNECTOR FOR CONNECTING TO CABLES

CROSS-REFERENCE TO RELATED APPLICATIONS

This patent application is relative of U.S. patent application entitled "ELECTRICAL CONNECTOR FOR CONNECTING TO CABLES", which is assigned to the same assignee as this application and is incorporated by reference herein in its entirety.

BACKGROUND OF THE INVENTION

1. Field of the Invention

The present invention relates to an electrical connector, and more particularly, to an electrical connector with a contact module for connecting to cables.

2. Description of Related Art

Chinese Patent Publication No. CN101359790A published on Feb. 4, 2009 discloses a conventional electrical connector including an insulative housing, a plurality of contacts assembled to the insulative housing, a metal shell enclosing the insulative housing, an inner PCB connected with the contacts and a bracket for supporting the inner PCB. The contacts are inserted into the insulative housing, independently, which will cause poor assembling efficiency. Mostly importantly, it is difficult to position the contacts in the insulative housing. Besides, the metal shell and the insulative housing lack of reasonable locking features and may easily get loose.

Hence, an improved electrical connector with improved contact module and improved locking features between the insulative housing and the metal shell are desired.

BRIEF SUMMARY OF THE INVENTION

The present invention provides an electrical connector including an insulative housing, a contact module received in the insulative housing and a plurality of cables connected to the contact module. The insulative housing includes a base and a mating portion protruding forwardly from the base. The base defines a receiving space. The mating portion defines a plurality of contact-receiving slots in communication with the receiving space. The contact module includes an insulative block and a plurality of contacts fixed in the insulative block through insert molding. The insulative block defines an upper surface and a lower surface opposite to the upper surface. The contacts includes a plurality of cantilevered contacting portions extending beyond the insulative block and a plurality of soldering pads exposed on the upper surface and the lower surface, respectively. The contact module is inserted into the insulative housing along a rear-to-front direction with the insulative block received in the receiving space and the cantilevered contacting portions are deformably received in the contact-receiving slots. The plurality of cables include a plurality of conductive cores electrically and mechanically connected to the soldering pads. The cantilevered contacting portions of adjacent contacts overlap each other from a side view, while the soldering pads of the adjacent contacts are offset from each other and exposed on the upper surface and the lower surface, respectively, from the side view.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE PREFERRED EMBODIMENT

Figure 1:
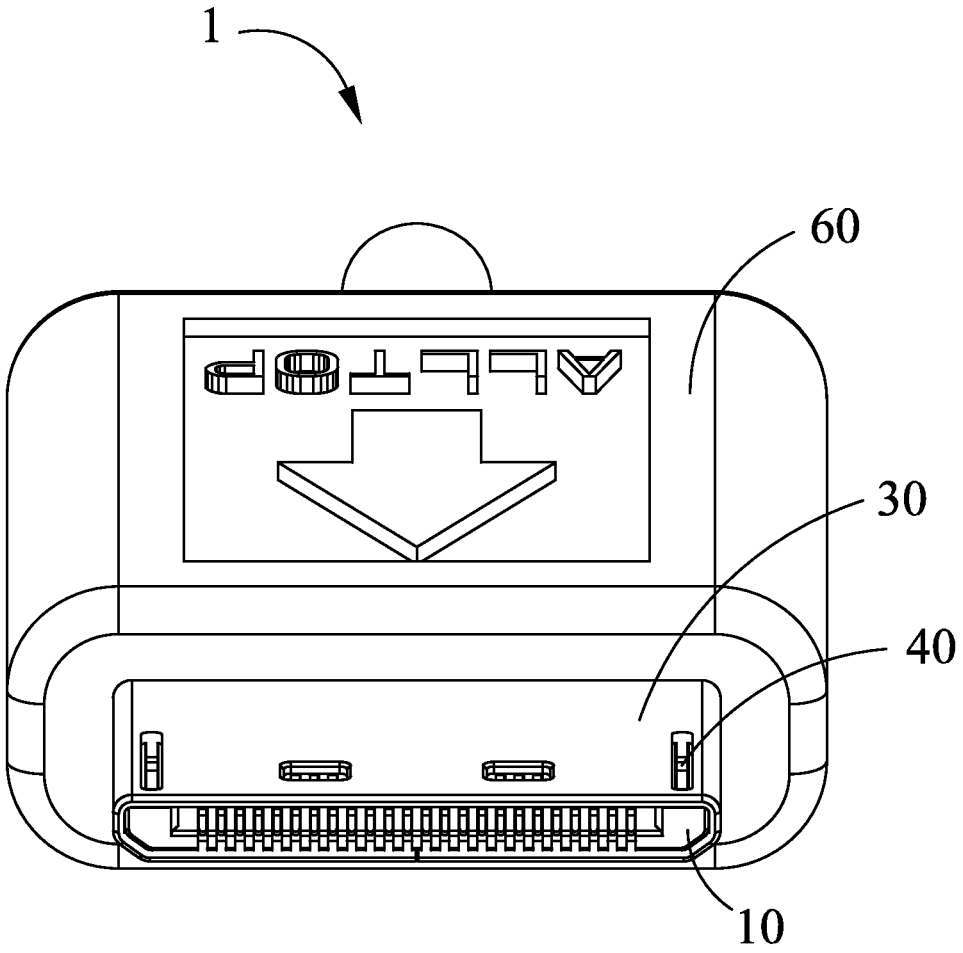
FIG. 1 is a perspective view of an electrical connector in accordance with an illustrated embodiment of the present invention.

Reference will now be made to the drawing figures to describe the embodiments of the present invention in detail. In the following description, the same drawing reference numerals are used for the same elements in different drawings.

Figure 2:
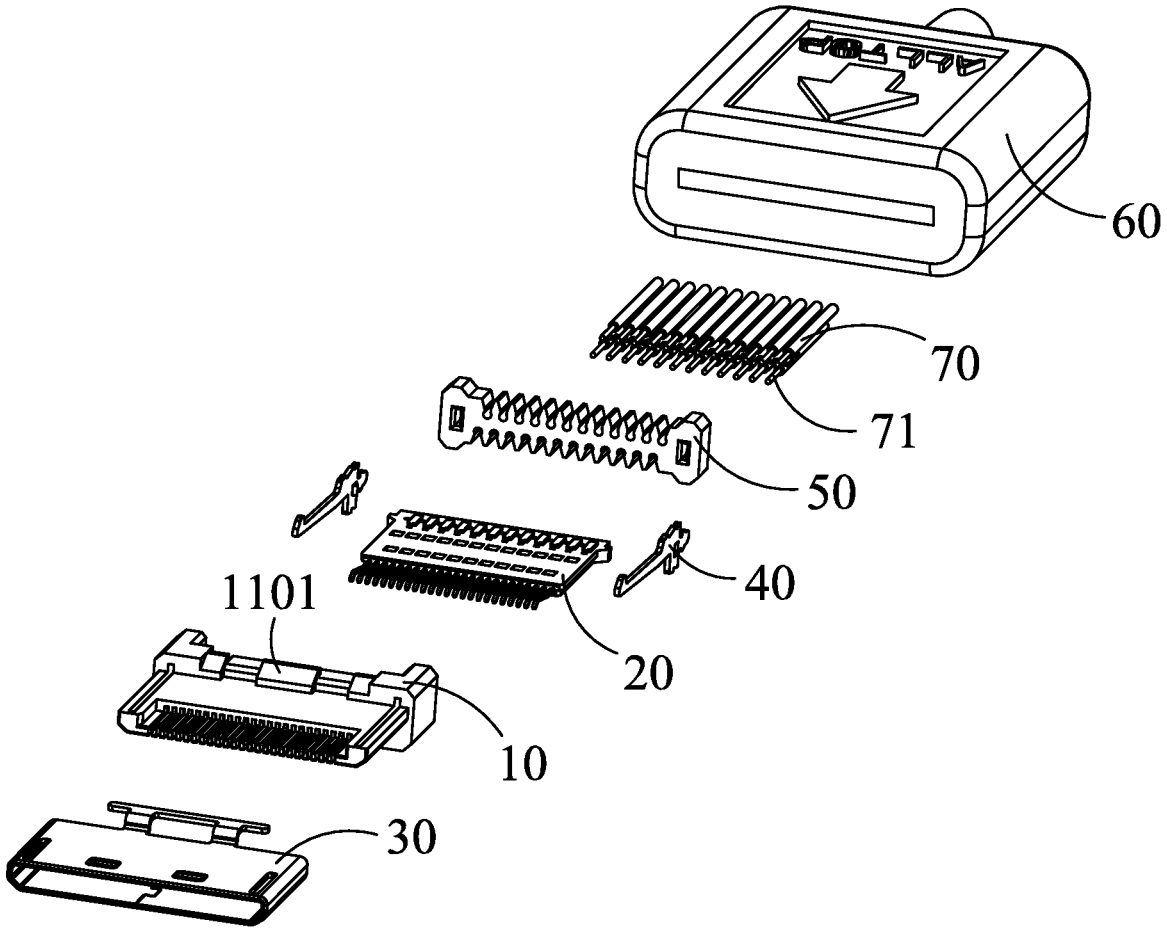
FIG. 2 is an exploded view of the electrical connector as shown in FIG. 1.

Referring to FIGS. 1 and 2, the present invention discloses an electrical connector 1 including an insulative housing 10, a contact module 20 inserted in the insulative housing 10, a metal shell 30 fixed to and enclosing the insulative housing 10, a pair of latches 40 received the in insulative housing 10 for locking with a complementary connector (not shown), a cable regulation block 50, a plurality of cables 70 connected to the contact module 20, and an outer shell 60 at least partly over-molding the metal shell 30 and the cables 70.

Figure 3:
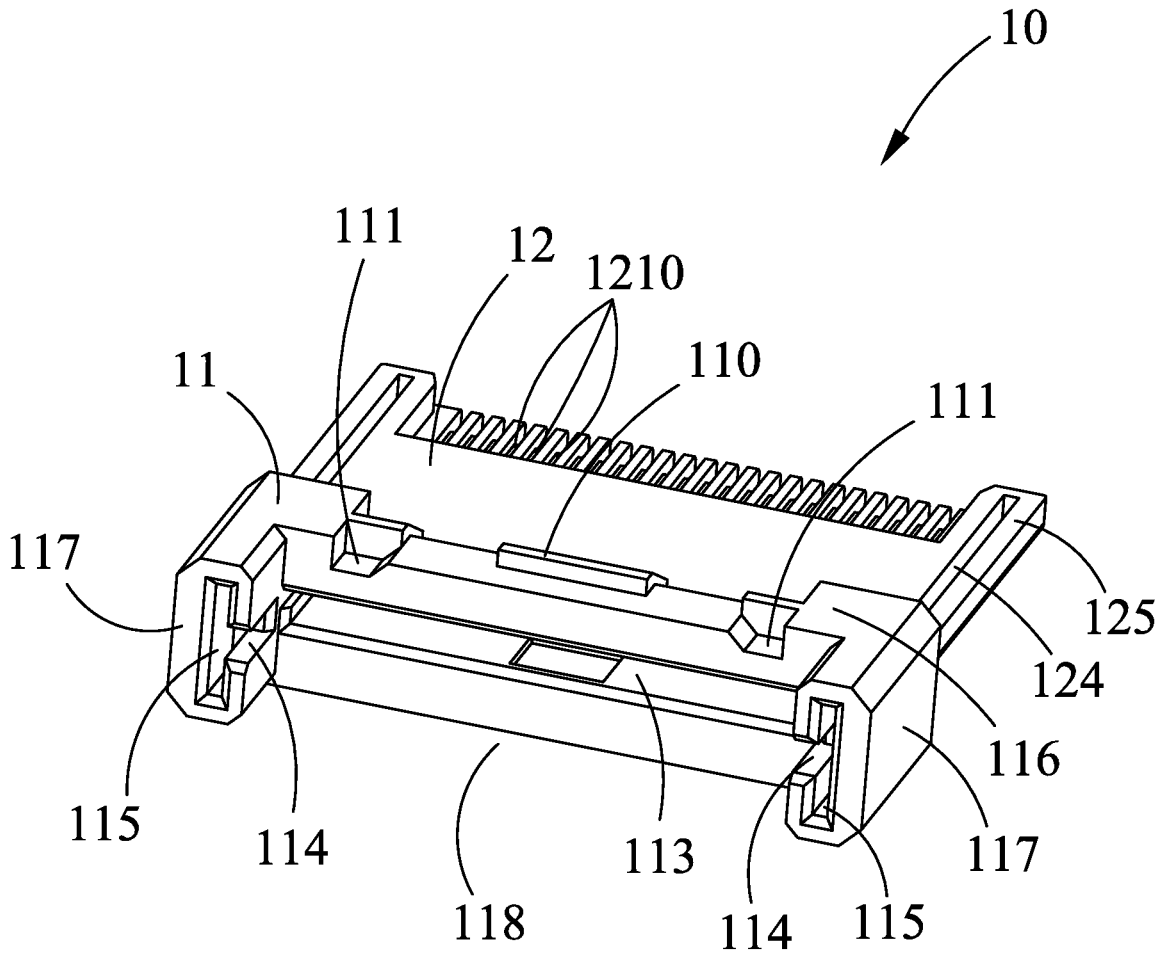
FIG. 3 is a perspective view of an insulative housing of the electrical connector as shown in FIG. 2.
Figure 4:
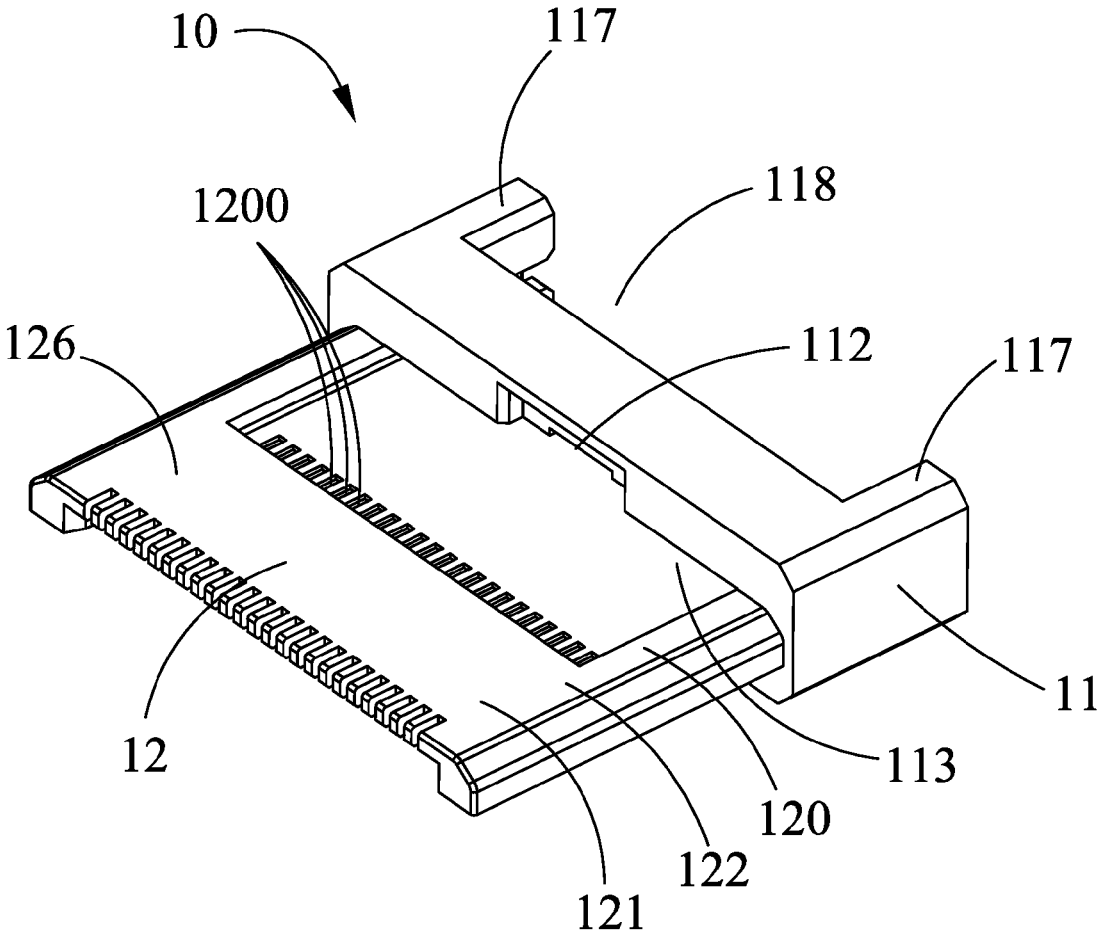
FIG. 4 is another perspective view of the insulative housing as shown in FIG. 3 while taken from a different aspect.
Figure 5:
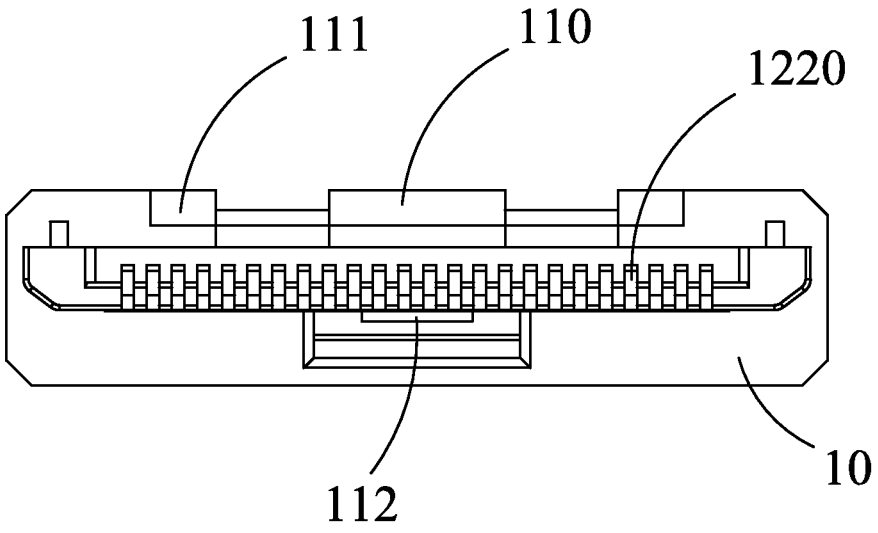
FIG. 5 is a front view of the insulative housing as shown in FIG. 2.
Figure 7:
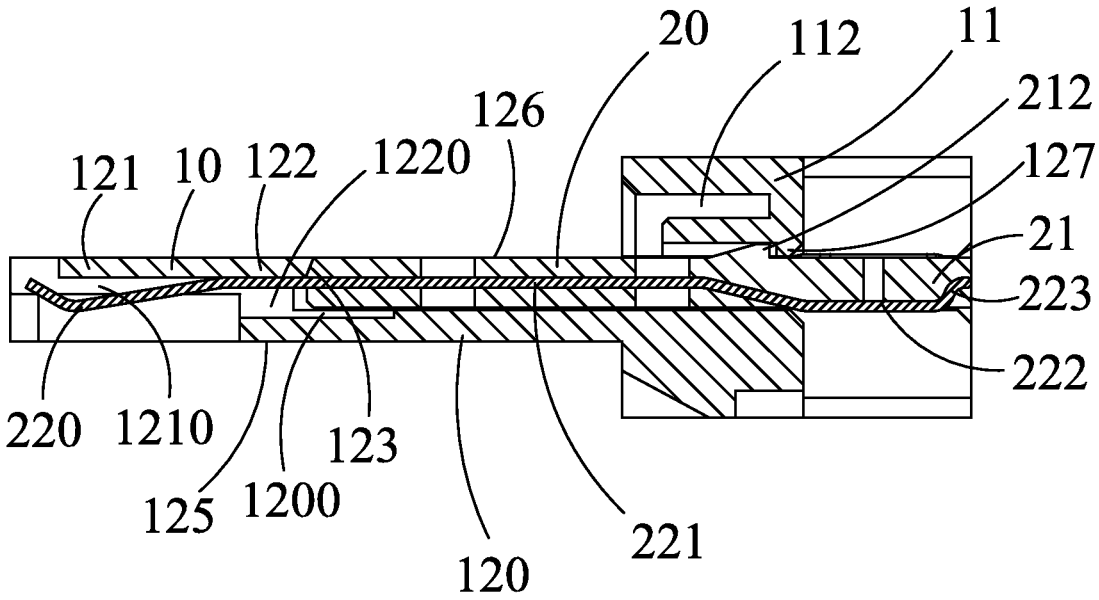
FIG. 7 is a schematic cross-sectional view of a part assembly with the contact module inserted in the insulative housing.

Referring to FIGS. 3, 5 and 7, the insulative housing 10 includes a base 11 and a mating portion 12 protruding forwardly from the base 11 for mating with the complementary connector. The base 11 is thicker and wider than the mating portion 12. As shown in FIGS. 3 and 4, the base 11 is U-shaped and includes a flange 116 and a pair of extensions 117 extending rearwardly from the flange 116. A space 118 is formed by the flange 116 and the pair of extensions 117. The flange 116 includes a raised block 110 having a front inclined guiding surface 1101 (as shown in FIG. 2) and a pair of depressions 111 at lateral sides of the raised block 110. The base 11 defines a receiving space 113 extending through the flange 116 along a rear-to-front direction. The receiving space 113 further extends into the mating portion 12 as shown in FIG. 4. The flange 116 further includes a receiving slot 112 below the receiving space 113. Each extension 117 defines a first fixing slot 114 in communication with the receiving space 113 and a second fixing slot 115 in communication with the first fixing slot 114. Referring to FIG. 3, the pair of first fixing slots 114 are located at opposite sides of the receiving space 113. The first fixing slot 114 and the second fixing slot 115 are essentially T-shaped in configuration. The second fixing slots 115 further extending into the mating portion 12.

Referring to FIGS. 3-5 and 7, the mating portion 12 includes a rear portion 120 connected with the base 11, a front portion 121 opposite to the rear portion 120 and a middle portion 122 connected between the front portion 121 and the rear portion 120. The receiving space 113 extends to the rear portion 120. The rear portion 120 defines a plurality of separated positioning slots 1200 exposed to the receiving space 113. The positioning slots 1200 are lower than the receiving space 113 for regulating the contact module 20. The front portion 121 defines a plurality of contact-receiving slots 1210 in communication with the receiving space 113. The middle portion 122 defines a plurality of passageways 1220 in communication with the contact-receiving slots 1210 and the receiving space 113. Besides, the mating portion 12 defines a top surface 125 and a bottom surface 126 opposite to the top surface 125. The receiving space 113 not only extends through a rear surface of the flange 116 along the rear-to-front direction but also extends through the bottom surface 126 of the mating portion 12 along a vertical direction. The contact-receiving slots 1210 extend through the top surface 125 of the mating portion 12. Besides, as shown in FIG. 7, the mating portion 12 includes an inclined guiding surface 123 exposed to the receiving space 113 for mating with the contact module 20. The second fixing slots 115 extend into the mating portion 12 so as to leave a pair of mounting slots 124 extending through the top surface 125.

Figure 6:
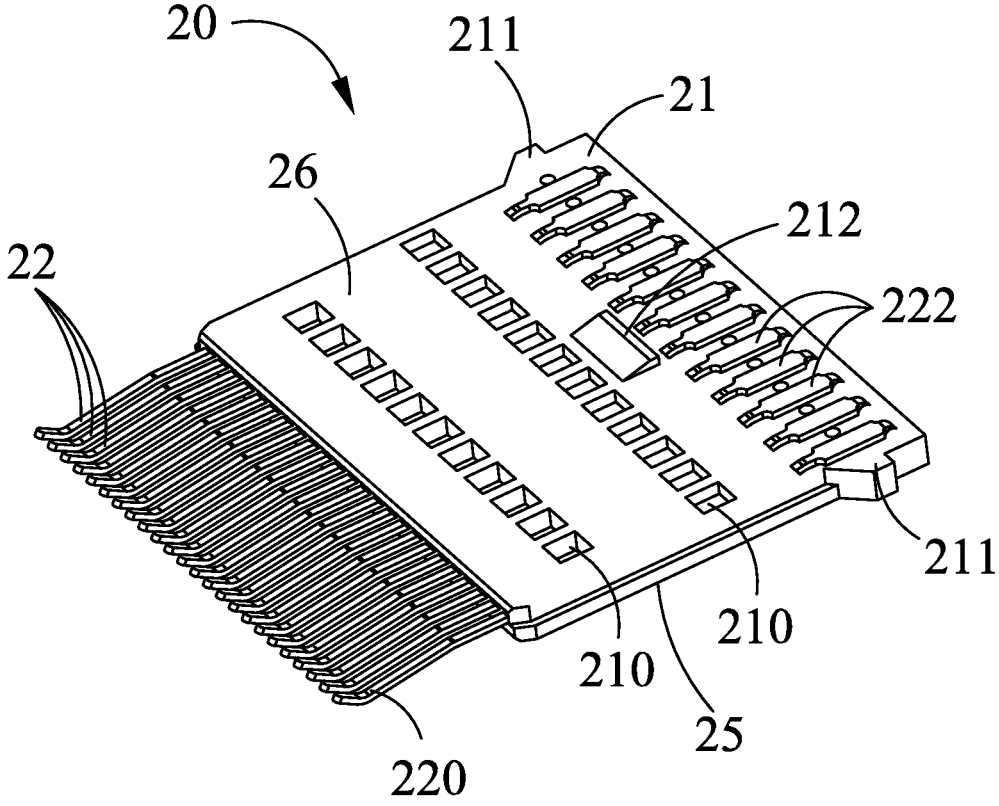
FIG. 6 is a perspective view of a contact module of the electrical connector as shown in FIG. 2.

Referring to FIGS. 6 and 7, the contact module 20 includes an insulative block 21 and a plurality of contacts 22 fixed in the insulative block 21 through insert molding. The insulative block 21 defines an upper surface 25, a lower surface 26 opposite to the upper surface 25, a pair of lateral protrusions 211 retained in the first fixing slots 114 along the rear-to-front direction, a raised protrusion 212 extending beyond the lower surface 26 for locking with a locking wall 127 of the base 11 (as shown in FIG. 7) and a plurality of positioning holes 210 extending through the upper surface 25 and the lower surface 26. The contacts 22 include a plurality of retaining portions 221 embedded in the insulative block 21, a plurality of cantilevered contacting portions 220 extending beyond the insulative block 21, a plurality of flat soldering pads 222 exposed on the upper surface 25 and the lower surface 26 of the insulative block 21, respectively, and a plurality of narrowed tabs 223 extending from the soldering pads 222. The contacting portions 220 are curved and are located at corresponding contacting arms which are deformable in the contact-receiving slots 1210.

According to the illustrated embodiment of the present invention, the cantilevered contacting portions 220 of the contacts 22 are arranged side by side and overlap each other from a side view. Each soldering pad 222 is wider than corresponding contacting portion 220. As a result, the contacting portions 220 are narrow enough to meet the requirement of side-by-side arrangement, and the soldering pads 222 are wide enough for easily and stably soldering. Under condition when the soldering pads 222 are alternately arranged in two parallel planes, a reasonable space can be provided for mounting the soldering pads 222 even if they are wider than the contacting portions 220. In other words, the soldering pads 222 of the adjacent contacts 22 are offset from each other along the vertical direction. The narrowed tabs 223 extend towards a middle plane between the upper surface 25 and the lower surface 26 of the insulative block 21 and embedded in the insulative block 21. As a result, the soldering pads 222 can be prevented from loosing from the insulative block 21. The contacting portions 220 and the soldering pads 222 are arranged at opposite sides of the flange 116 along the rear-to-front direction. The soldering pads 222 reside in the space 118 for easily connected to the cables 70.

Figure 8:
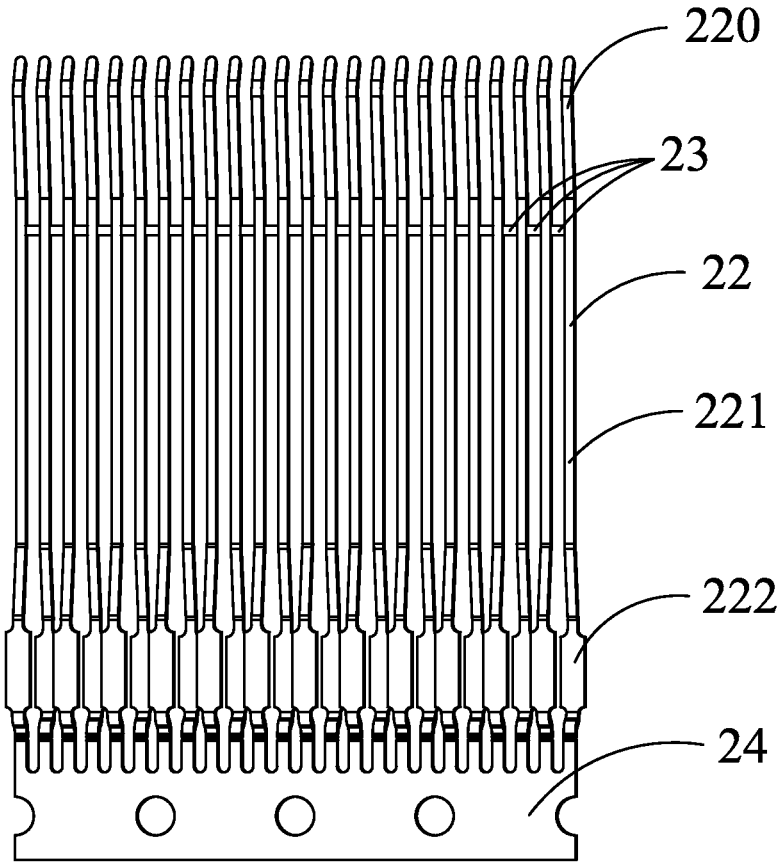
FIG. 8 is a perspective view of a plurality of contacts connected with each other by a plurality of bridges and a carrier strip.

Referring to FIG. 6, the positioning holes 210 are arranged in two parallel lines along a front-to-back direction and are located between each adjacent retaining portions 221. A tool (not shown) is applied to position the contacts 22 during insert molding processes. Once the tool is removed, the positioning holes 210 are left. Referring to FIG. 8, before insert molding, when the contacts 22 are stamped from a metal sheet, they are connected with each other by a plurality of bridges 23 and a carrier strip 24. In such arrangement, the contacts 22 can be prevented from offsetting during insert molding. Understandably, the bridges 23 are removed by stamping to separate each contact 22 and the carrier strip 24 is also removed after insert molding.

Referring to FIG. 7, when the contact module 20 is assembled to the insulative housing 10 along the rear-to-front direction, front ends of the contacting portions 220 are guided by the inclined guiding surface 123 so that the contacts 22 can be prevented from broken or crashed to be oblique during assembling. The contacting portions 220 are initially positioned by the positioning slots 1200 so that they can be prevented from offsetting in assembling. With further insertion of the contact module 20, the contacting portions 220 pass through the passageways 1220 and ultimately received in the contact-receiving slots 1210. Under this condition, the raised protrusion 212 of the contact module 20 defines over the locking wall 127 of the base 11 so that the locking wall 127 can be adapted for preventing the contact module 20 from withdrawing from the insulative housing 10. The pair of lateral protrusions 211 are retained in the pair of first fixing slots 114 for realizing guiding and positioning. The insulative block 21 is received in the receiving space 113. The lower surface 26 of the insulative block 21 is coplanar with the bottom surface 126 of the mating portion 12.

Figure 9:
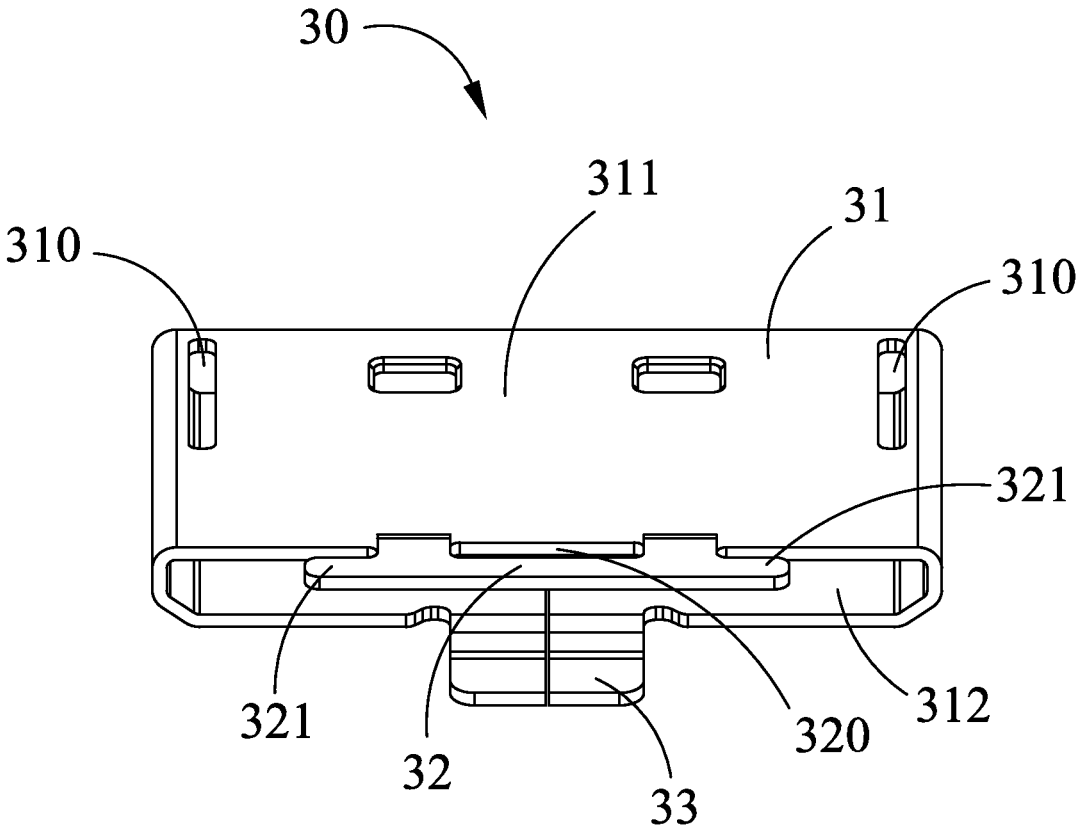
FIG. 9 is a perspective view of a metal shell of the electrical connector as shown in FIG. 2.

Referring to FIG. 9, the metal shell 30 includes a sleeve portion 31 enclosing the mating portion 12 of the insulative housing 10, a rear extension 32 extending rearwardly and upwardly from a top wall 311 of the sleeve portion 31, and a tongue 33 extending rearwardly from a bottom wall 312 of the sleeve portion 31. The top wall 311 defines a pair of slots 310 corresponding to the pair of mounting slots 124 of the insulative housing 10. The rear extension 32 defines a cutout 320 to receive the raised block 110 under the guidance of the front inclined guiding surface 1101. Besides, the rear extension 32 further includes a pair of wings 321 stamped to be received in the depressions 111 of the insulative housing 10 so that the metal shell 30 can be prevented from withdrawing from the insulative housing 10. The tongue 33 is fixed in the receiving slot 112 of the insulative housing 10. Since the receiving slot 112 is located below a locking position of the raised protrusion 212, the whole structure of the insulative housing 10 and the metal shell 30 can be improved.

Figure 10:
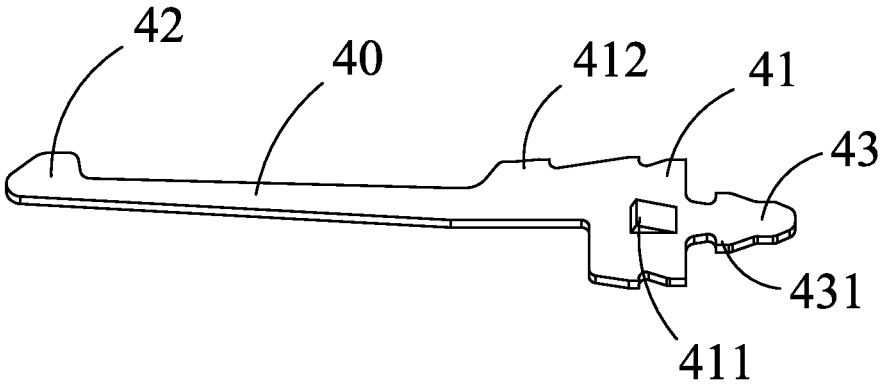
FIG. 10 is a perspective view of a latch of the electrical connector as shown in FIG. 2.

Referring to FIGS. 2 and 10, the pair of latches 40 are assembled to the insulative housing 10 along the rear-to-front direction from the second fixing slots 115. Each latch 40 includes a main portion 41, a locking arm 42 extending forwardly from the main portion 41 and a mounting protrusion 43 extending backwardly from the main portion 41. The locking arms 42 extend into the mounting slots 124 of the insulative housing 10 and further extend upwardly through the slots 310 of the metal shell 30. The main portion 41 is stamped to form an inclined tab 411 protruding into the first fixing slot 114 and resisting against corresponding lateral protrusion 211 of the insulative block 21. The pair of latches 40 are symmetrical with the inclined tabs 411 extending towards each other. As a result, the latches 40 can be prevented from incorrectly inserted into the mismatching second fixing slots 115. The main portion 41 includes a plurality of engaging barbs 412 for improving friction force between the main portion 41 and the second fixing slots 115. The mounting protrusions 43 extend rearwardly beyond the base 11 for retaining the cable regulation block 50.

Figure 11:
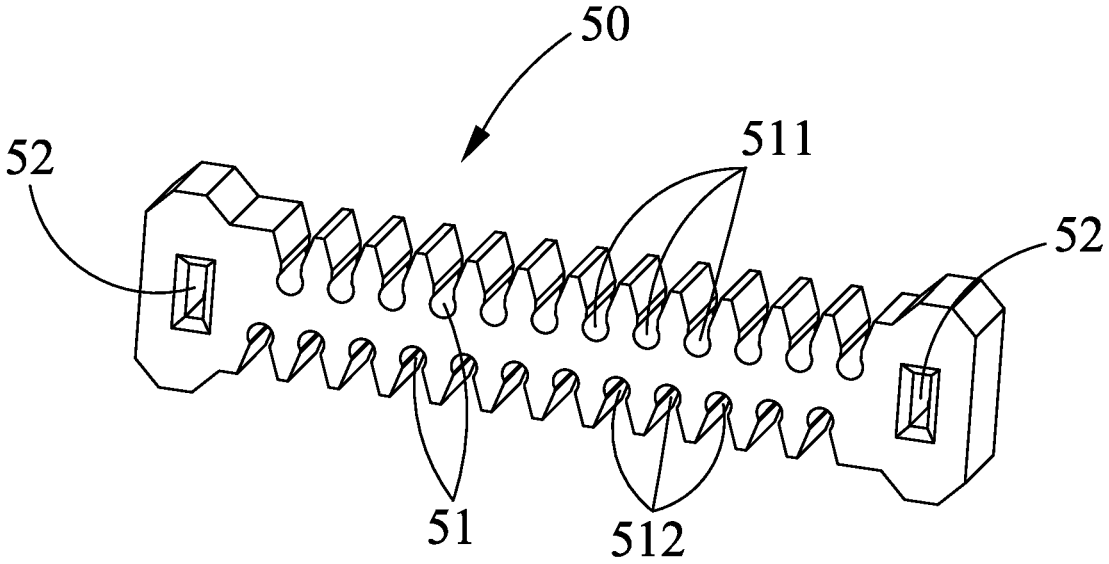
FIG. 11 is a perspective view of a cable regulation block of the electrical connector as shown in FIG. 2.

Referring to FIG. 11, the cable regulation block 50 defines a pair of side through holes 52 for fixing the mounting protrusions 43 and a plurality of openings 51 for positioning the cables 70. In order to improving friction force therebetween, each mounting protrusion 43 includes at least one barb 431 locking with corresponding side through hole 52. The openings 51 comprise an upper line of first openings 511 and a lower line of second openings 512. The first openings 511 are offset from the second openings 512 along the vertical direction. However, the cable regulation block 50 is the same as the cable regulation block 50 which flips 180 degrees. That is to say, the cable regulation block 50 is suitable to keep the cables 70 in position even if the cable regulation block 50 flips 180 degrees. Under this arrangement, either a front surface or an end surface of the cable regulation block 50 can be assembled to the latches 40 for improving assembling efficiency.

Referring to FIG. 2, the cables 70 are positioned in the first openings 511 and the second openings 512 of the cable regulation block 50. Each cable 70 includes a conductive core 71 electrically and mechanically connected to the soldering pad 222. According to the illustrated embodiment of the present invention, the conductive cores 71 are soldered to the soldering pads 222.

Referring to FIGS. 1 and 2, the outer shell 60 at least partly over-molds the metal shell 30 and the cables 70 so that inner electrical and mechanical connections of the electrical connector 1 can be protected. Besides, the outer shell 60 can be easily gripped by end users.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broadest general meaning of the terms in which the appended claims are expressed.

What is claimed is:

1. An electrical connector comprising:

an insulative housing comprising a base and a mating portion protruding forwardly from the base, the base defining a receiving space, the mating portion defining a plurality of contact-receiving slots in communication with the receiving space;

a contact module comprising an insulative block and a plurality of contacts fixed in the insulative block through insert molding, the insulative block defining an upper surface and a lower surface opposite to the upper surface, the contacts comprising a plurality of cantilevered contacting portions extending beyond the insulative block and a plurality of soldering pads exposed on the upper surface and the lower surface, respectively, the contact module being inserted into the insulative housing along a rear-to-front direction with the insulative block received in the receiving space and the cantilevered contacting portions deformably received in the contact-receiving slots;

a plurality of cables with a plurality of conductive cores electrically and mechanically connected to the soldering pads;

a cable regulation block defining a pair of side through holes and a plurality of openings for positioning cables; and a pair of latches received in the insulative housing for locking with a complementary connector, each latch further comprising a mounting protrusion extending rearwardly beyond the rear surface of the base and fixed in a corresponding one of the side through holes; and wherein the cantilevered contacting portions of adjacent contacts overlap each other from a side view, while the soldering pads of the adjacent contacts are offset from each other and exposed on the upper surface and the lower surface, respectively, from the side view.

2. The electrical connector as claimed in claim 1, wherein the mating portion defines a top surface and a bottom surface opposite to the top surface, the receiving space not only extending through a rear surface of the base along the rear-to-front direction but also extending through the bottom surface of the mating portion along a vertical direction, the contact-receiving slots extending through the top surface of the mating portion.

3. The electrical connector as claimed in claim 2, wherein the lower surface of the insulative block is coplanar with the bottom surface of the mating portion.

4. The electrical connector as claimed in claim 2, wherein the mating portion comprises a rear portion connected with the base, a front portion opposite to the rear portion and a middle portion connected between the front portion and the rear portion, the receiving space partly formed in the rear portion, the contact-receiving slots formed in the front portion, the middle portion defining a plurality of passageways in communication with the contact-receiving slots and the receiving space.

5. The electrical connector as claimed in claim 4, wherein the rear portion further defines a plurality of separated positioning slots exposed to the receiving space, the positioning slots being in communication with the passageways and adapted for positioning the cantilevered contacting portions when the contact module is inserted into the insulative housing along the rear-to-front direction.

6. The electrical connector as claimed in claim 1, wherein the mating portion comprises an inclined guiding surface exposed to the receiving space for guiding insertion of the cantilevered contacting portions.

7. The electrical connector as claimed in claim 2, wherein the base defines a pair of first fixing slots extending through the rear surface, the first fixing slots being located at opposite sides of the receiving space and being in communication with the receiving space, the insulative block comprising a pair of lateral protrusions retained in the first fixing slots along the rear-to-front direction.

8. The electrical connector as claimed in claim 7, wherein the base defines a pair of second fixing slots extending through the rear surface and further extending into the mating portion along the rear-to-front direction, the second fixing slots being located at opposite sides of the first fixing slots and being in communication with the first fixing slots, respectively, the pair of latches inserted in the second fixing slots along the rear-to-front direction, each latch comprising a locking arm extending beyond the top surface of the mating portion and an inclined tab protruding into the first fixing slot and resisting against corresponding lateral protrusion of the insulative block.

9. The electrical connector as claimed in claim 8, wherein the pair of latches are symmetrical with the inclined tabs extending towards each other.

10. The electrical connector as claimed in claim 8, wherein each mounting protrusion comprises at least one barb locking with corresponding side through hole.

11. The electrical connector as claimed in claim 8, wherein the openings comprise an upper line of first openings and a lower line of second openings, the first openings being offset from the second openings along the vertical direction, the cable regulation block being the same as the cable regulation block which flips 180 degrees.

12. The electrical connector as claimed in claim 1, wherein the base comprises a raised block having a front inclined guiding surface, the electrical connector further comprising a metal shell, the metal shell comprising a sleeve portion enclosing the mating portion of the insulative housing and a rear extension extending rearwardly and upwardly from a top wall of the sleeve portion, the rear extension defining a cutout to receive the raised block under the guidance of the front inclined guiding surface.

13. The electrical connector as claimed in claim 12, wherein the base defines a pair of depressions at lateral sides of the raised block and the rear extension comprises a pair of wings stamped to be received in the depressions.

14. A contact module for connecting cables comprising:

an insulative block defining an upper surface and a lower surface opposite to the upper surface; and a plurality of contacts fixed in the insulative block through insert molding, the contacts comprising a plurality of retaining portions embedded in the insulative block, a plurality of contacting arms cantileveredly extending beyond the insulative block and a plurality of flat pads exposed on the upper surface and the lower surface, respectively, each contacting arm comprising a curved contacting portion for mating with a complementary connector; wherein the contacting arms of adjacent contacts overlap each other from a side view, while the flat pads of the adjacent contacts are spaced from each other along a vertical direction and exposed on the upper surface and the lower surface, respectively, from the side view; wherein the contacts further comprise a plurality of narrowed tabs extending from the flat pads, the narrowed tabs extending towards a middle plane between the upper surface and the lower surface of the insulative block and embedded in the insulative block.

15. The contact module as claimed in claim 14, wherein the insulative block defines a plurality of positioning holes extending through the upper surface and the lower surface and located between each adjacent retaining portions.

16. The contact module as claimed in claim 15, wherein the positioning holes are arranged in two parallel lines along a front-to-back direction.

17. The contact module as claimed in claim 14, wherein each flat pad is wider than corresponding contacting arm.

18. The contact module as claimed in claim 14, wherein the insulative block comprises a pair of lateral protrusions beyond lateral sides thereof and a raised protrusion protruding beyond the lower surface.

* * * * *